US007686668B1

(12) United States Patent
Butler

(10) Patent No.: US 7,686,668 B1
(45) Date of Patent: Mar. 30, 2010

(54) INTERIOR SCENTING OF LATEX BALLOONS

(76) Inventor: Sean W. Butler, 5116 Sprinter Ct., Lafayette, IN (US) 47905

( * ) Notice: Subject to any disclaimer, the term of this patent is extended or adjusted under 35 U.S.C. 154(b) by 546 days.

(21) Appl. No.: 11/549,062

(22) Filed: Oct. 12, 2006

Related U.S. Application Data

(60) Provisional application No. 60/725,223, filed on Oct. 12, 2005.

(51) Int. Cl.
*A63H 3/06* (2006.01)
*A63H 3/00* (2006.01)

(52) U.S. Cl. ..... 446/220; 239/1

(58) Field of Classification Search ..... 446/220–226; 239/1, 8

See application file for complete search history.

(56) References Cited

U.S. PATENT DOCUMENTS 4,142,322 A 3/1979 Zeyra
4,586,910 A * 5/1986 Buchanan ..... 446/220
4,828,176 A 5/1989 Crowe
5,577,947 A * 11/1996 Malloy et al. ..... 446/220
5,964,636 A 10/1999 Carrera
6,158,676 A 12/2000 Hughes
2004/0136912 A1 7/2004 Murray et al.
2006/0005328 A1 * 1/2006 Johnson ..... 12/128 R

OTHER PUBLICATIONS

DesignWare/American Greetings Corp., "Strawberry Shortcake" Strawberry Scented Balloon product, 2003.
Bieleman, Additives for Coatings, Wiley-VCH, 2000, 4 pages.
Lanzer, Mastering Endovascular Techniques: A Guide to Excellence, LW&W, Sep. 1, 2006, 1 page.

* cited by examiner

*Primary Examiner*—Kien T Nguyen
(74) *Attorney, Agent, or Firm*—Fliesler Meyer LLP

(57) ABSTRACT

A method of coating the interior surface of a latex balloon with a gaseous fragrance or scented formula, using a micro infusion injector.

4 Claims, 1 Drawing Sheet

INTERIOR SCENTING OF LATEX BALLOONS

CLAIM OF PRIORITY

U.S. Provisional Patent Application No. 60/725,223 entitled Interior Scenting of Latex Balloons, by Sean W. Butler, filed Oct. 12, 2005.

BACKGROUND OF THE INVENTION

The invention relates to latex balloons and scenting additives. Colorful inflated balloons are a significant and common symbol of universal celebration. Whether at holiday events, conventions, festivals, music concerts, or family gatherings such as birthdays, weddings, anniversaries, showers, etc., colorful balloons represent celebration and special occasions to everyone, everywhere in the world. Along with the celebratory effect of colorful balloons are the unique and interesting scents that are associated with such events. Scents are used in the marketplace as an additive in a wide array of products, including "plug-in" room air fresheners, automotive "vent" fragrance devices, "scented" baby dolls, "scented" magic markers, "scented" liquid bubble blowers, and even "scented" bowling balls. A colorful latex balloon that, when inflated, automatically gives off a pleasant scent or smell—such as a white balloon with flower scent for a wedding or a green balloon with a pine scent for the Christmas holiday—would provide a simple and inexpensive way to enhance any celebration experience.

SUMMARY OF THE INVENTION

The present invention is a method of coating the inner surfaces of an uninflated latex balloon with a gaseous fragrance formula. The porous nature of the elastic balloon absorbs the fragrance molecules into the permeable sponge-like character of the latex. The balloons are then immediately packaged.

The invention manufacturing system injects a micro-diffused gaseous mix of fragrance or scent into the interior of the latex balloon. This prescribed mixture of air and atomized fragrance formulation of essential oils provides for the diffusive coating of the entire inner surface of the balloon. This gaseous low-pressure diffusion of fragrance is ultimately absorbed into the porous matrix of the balloon, trapping the atomized essential oils mixture within the latex, thereby, fragrancing each balloon.

The previously described process is achieved through the insertion of a pressurized micro diffusion injector equipped with a micro porous tip midway into the balloon cavity. The injector is then triggered dispersing the gaseous fragrance. After "X" period of time the gaseous emission is stopped after the fragrance mixture has coated the entire inner surface of the balloon, this mixture is then absorbed into the porous latex surface.

The end result of the scenting process, whether done manually or automatically, is that the uninflated latex porous body of the balloon becomes scented or aromatically fragranced. Fragrance molecules remain embedded within the latex membrane, and the scented balloons are packaged in an air-tight blister. When inflated, the expanding, elastic porous latex walls bring about a diffusion of the embedded essential oil molecules thus scenting the surrounding area. Fragrance molecules remain within the porous latex walls for some time, as a function of the balloon wall thickness. By this process a "red" balloon can smell like "wild cherry", or a "green" "Christmas" balloon just like a pine tree. The possible combinations are only limited by imagination and market needs.

DETAILED DESCRIPTION OF THE INVENTION

Figure 1:
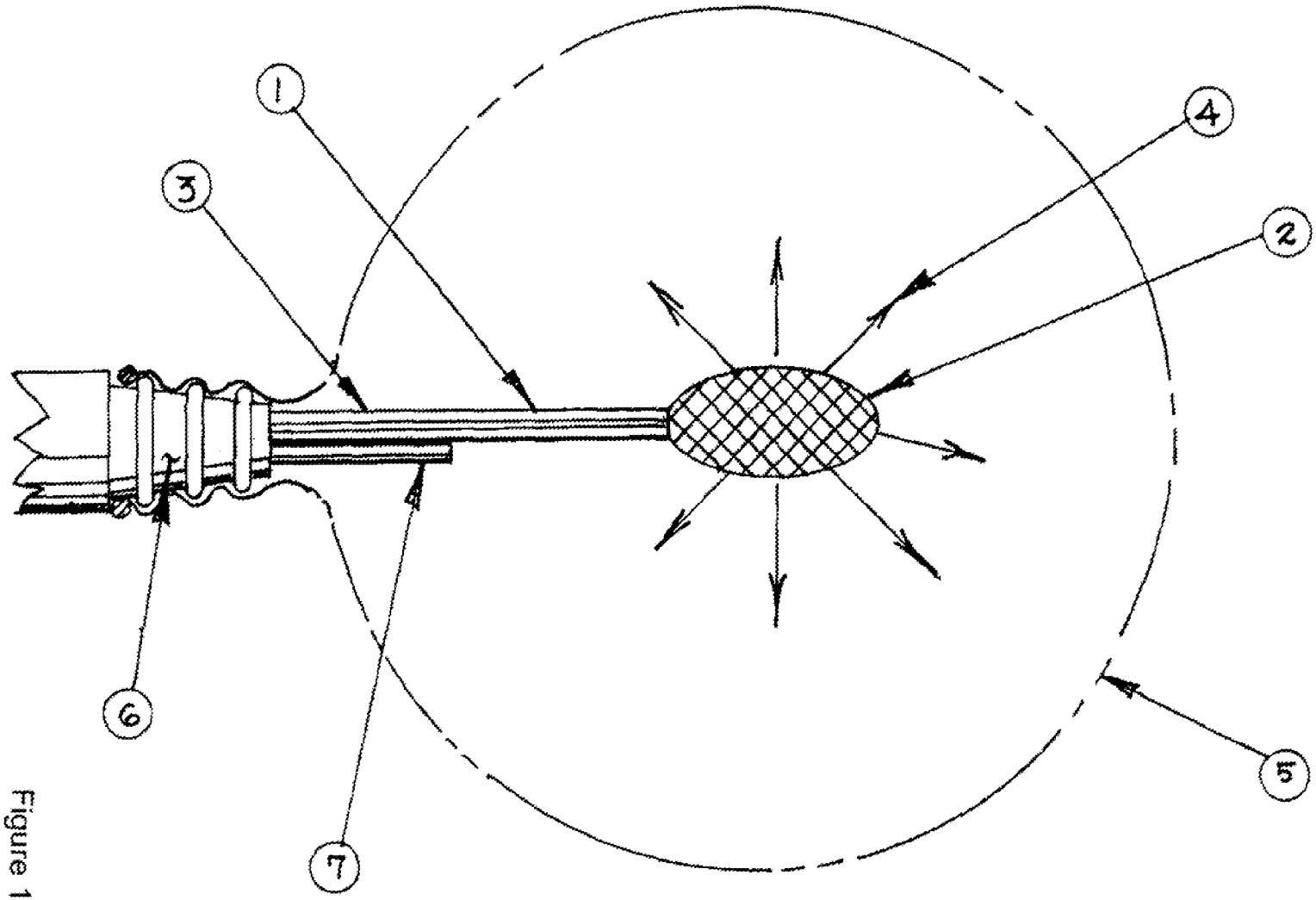
FIG. 1 is an illustrative drawing of the apparatus used for scenting a balloon.

FIG. 1 shows a Micro Diffusion Injector 1, consisting of a Micro Diffusion Nozzle 2 made of sintered metal or any other micro porous material, Feed Tube 3, Ribbed Balloon Gripper 6, Gaseous Mixture of Fragrance 4, Latex Balloon 5 and Air Injector Port 7.

As can be seen from the attached drawing and the design features listed above, three steps are utilized to properly scent the interior of Latex Balloon 5.

In Step 1, a Latex Balloon 5 is placed over Micro Diffusion Injector 1, and the neck of Latex Balloon 5 is stretched and sealed over Ribbed Nozzle 6 of Micro Diffusion Injector 1.

In Step 2, a metered puff of air is introduced through Air Injector Port 7 to partially inflate Latex Balloon 5.

In Step 3, a measured amount of Gaseous Mixture of Fragrance 4 is injected under pressure into Latex Balloon 5 through Feed Tube 3 and Micro Diffusion Nozzle 2 of Micro Diffusion Injector 1 which coats and permeates the inner surfaces of Latex Balloon 5. This invention provides for production of scented latex balloons ready for packaging and marketing for the purposes outlined in the Background statement shown above. This invention clearly lends itself to the high volume production of scented balloons using robotics and controls.

What is claimed is:

1. A method of providing a scented balloon, comprising:

a) placing a latex balloon over a micro diffusion injector including stretching a neck of the balloon over a ribbed nozzle of the micro diffusion injector;

b) introducing a puff of air through an air injector port on the micro diffusion injector to partially inflate the latex balloon;

c) injecting under pressure into the partially inflated latex balloon a micro-diffused gaseous mixture of a fragrance through a feed tube and micro diffusion nozzle of the micro diffusion injector; and d) allowing the gaseous mixture to coat and permeate the inner surface of the latex balloon.

2. The method of providing a scented balloon of claim 1, wherein the micro-diffused gaseous mixture comprises a mixture of air and atomized fragrance formulation of essential oils.

3. The method of providing a scented balloon of claim 1, wherein the micro diffusion nozzle is inserted midway into the latex balloon cavity.

4. The method of providing a scented balloon of claim 1, wherein the fragrance is released into a surrounding environment upon inflation of the latex balloon.

* * * * *